United States Patent [19]

Garrison, Jr., deceased et al.

[11] 3,936,990

[45] Feb. 10, 1976

[54] CEILING PANEL TRIM MOUNTING MEANS

[76] Inventors: David H. Garrison, Jr., deceased, late of Boca Raton, Fla., by Richard J. Alfieri, executor, 930 N. Federal Highway, Pompano Beach, Fla. 33062

[22] Filed: Apr. 1, 1975

[21] Appl. No.: 564,161

[52] U.S. Cl. ..... 52/717; 52/287; 52/463

[51] Int. Cl.[2] ..... E04B 5/52

[58] Field of Search ..... 52/466, 287, 286, 144, 52/145, 716, 717, 461, 463, 476, 511, 510, 489, 495

[56] References Cited

UNITED STATES PATENTS

| | | | |
|---|---|---|---|
| 1,997,607 | 4/1935 | Strom | 52/489 |
| 2,082,314 | 6/1937 | Venzie | 52/489 |
| 2,141,700 | 12/1938 | Tinnerman | 52/511 |
| 2,286,890 | 6/1942 | Birt | 52/489 |
| 2,996,765 | 8/1961 | Nelsson | 52/489 |

*Primary Examiner*—John E. Murtagh

[57] ABSTRACT

There is disclosed suspended ceiling construction in which the usual grid members are provided, having exposed surfaces which are to be covered by trim bodies, said bodies being connected to the members by the clips of the invention which interengage with the grid members and are connected to the bodies by inserting interlocking elements of said clips into suitable recesses formed in the bodies.

6 Claims, 7 Drawing Figures

CEILING PANEL TRIM MOUNTING MEANS

OBJECTS OF THE INVENTION

It is a principal object of this invention to provide for the application of decorative ceiling division members in conjunction with suspended ceiling construction.

It is a further object of this invention to provide means which will enable the easy affixing of trim bodies in the form of strips or the like, to existing grid members by connection of the same with the said grid members including the main tees, cross tees and wall angles making up the same.

A further and additionally important object is to form the trim bodies in strips which have recesses included therein, which recesses provide for the means to fasten the bodies to the grid members.

Another further object of the invention is to provide a novel form of clip or clips which will be useful in mounting the trim bodies to the grid members by simple application of the same, including mating of the clips with recesses in the trim members and engaging of the clips with the grid members so as to facilitate such installation by relatively unskilled persons.

Other and further objects of the invention will be understood from a consideration of the specification appended hereto and disclosed in the drawing, wherein.

DESCRIPTION OF THE INVENTION

Figure 1:
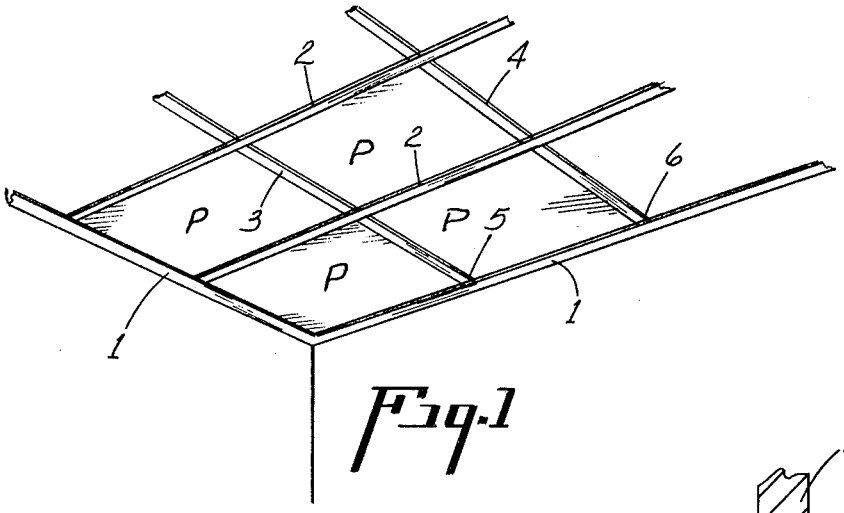
FIG. 1 is a generally illustrative disclosure of a suspended ceiling looking towards the corner of a room in which said ceiling is installed, to illustrate generally the wall angles, cross tees and main tees which comprise the grid members and provide for the support of ceilingpanels thereby.

Referring now to FIG. 1, there is disclosed a corner of a room looking toward the ceiling thereof in which wall angles 1 are fastened to the wall below the top of the wall, and extending from the said wall angles in one direction are the main tees 2, with cross tees such as 3 and 4 which are connected to the main tees 2 in any preferred manner and supported at their ends denoted 5 and 6 respectively by the wall angle 1 as generally shown and as is relatively well known in the art.

These tees andangles will be denoted grid members and are designed to support ceiling panels thereon, in the usual and preferred manner, and designated P.

Figure 3:
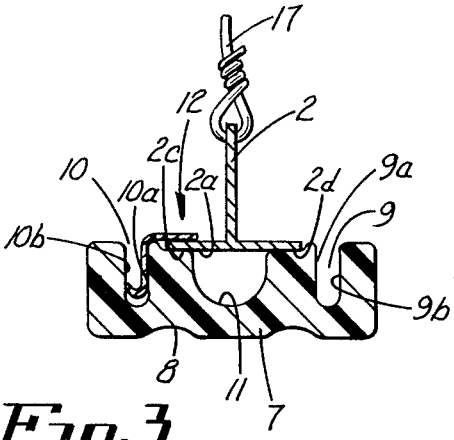
FIG. 3 is a cross sectional view, fragmentary in nature, illustrating the manner of connection of a trim body to a cross tee or main tee with the clip shown in place with respect thereto.

The invention hereof is directed to the means for supporting certain decorative trim bodies from said grid members, and is further illustrated in the other figures herein, FIG. 3 being referred to initially as showing in section a trim body 7, which is preferably formed of a rigid, cellular, poly vinyl chloride extrusion, so that same may be made in continuous long lengths and will usually be coated or covered with an outer skin such as 8 of decorative nature.

The trim body 7 is provided with recesses 9 and 10 extending longitudinally thereof and of continuous nature in this disclosure, of a particular preferred dimension, each having a side 9*a* and 9*b* in recess 9, and 10*a* and 10 *b* in recess 10.

An additional longitudinal recess 11 not particularly important to this invention but provided to lighten and reduce the amount of material used in the manufacture of the trim bodies, likewise extend longitudinally or throughout the length of such body.

Figure 6:
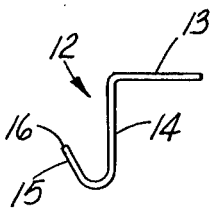
FIG. 6 is a side view of the said clip.
Figure 7:
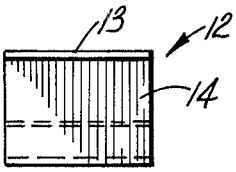
FIG. 7 is a rear view of the clip hereof.

Since it is desired to support the trim body such as 7 with respect to both the main tees 2 and cross tees 3 and 4, the clip of this invention will now be described, and shown more particularly in FIGS. 4 to 7 inclusive designated 12, and comprising a portion 13 in the form of a platform, and a section 14 integral therewith and extending downwardly therefrom in the form of a depending leg, which depending leg or section 14 is further formed as its extremity with offstanding element of angular form denoted 15 which is reversely bent so to speak, and illustrated in side elevation particularly in FIG. 6, terminating in an edge 16.

It is noted that the clip just heretofore described will preferably be made of relatively thin spring-like material, and spring steel is a desirable material, for purposes which will appear as this description proceeds.

Figure 4:
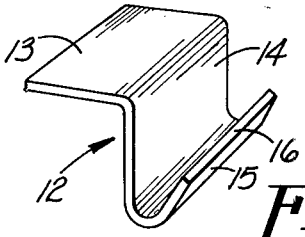
FIG. 4 is a perspective view of a clip in accordance with the disclosure herein.
Figure 5:
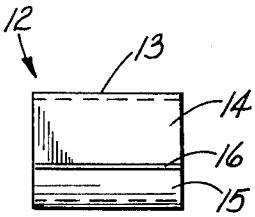
FIG. 5 is what may be termed a front view of the clip of this invention.

Referring again to FIG. 3, it will be noted that the recess 10 is shown as having positioned therein a clip 12 in accordance with the detailed description in reference to FIG. 4 which clip 12 has been pressed into the recess 10 with the section 14 of said clip against the side 10*a*, and the extremity 15 of said section 14 engaging the opposite side 10*b* and pressing with substantial spring pressure against said recess so as to retain the clip 12 in place as shown.

Since the trim body 7 has been positioned beneath the tee, which for the purpose of this description will be designated tee 2, and particularly against the normally exposed surface 2*a* thereof, which in turn is that surface of the tee 2, this being an inverted tee as will be apparent which comprises oppositely extending flanges 2*c* and 2*d*.

The trim body 7 is positioned as shown and the clips such as 12 placed as indicated, so that the platform 13 or portion of the clip 12 will extend over the upper surface of the flange 2*c* and thereby maintain the clip in position as illustrated with the trim body fastened thereby.

Since the tee 2 is suspended from the ceiling by the wire or other means such as 17, the trim body 7 will likewise be suspended thereby.

It is of course contemplated that additional clips will be used and positioned in the recess 9 so as to engage with the sides 9*a* and 9*b* thereof in a manner similar to the manner in which the clip 12 engages the recess 10 to thereby firmly fix the trim body 7 in place.

It is of course contemplated that the trim body will extend along the main tees 2 and of course along the cross tees 3 and 4 likewise to cover the lower surfaces of the grid members as previously pointed out in detail.

Figure 2:
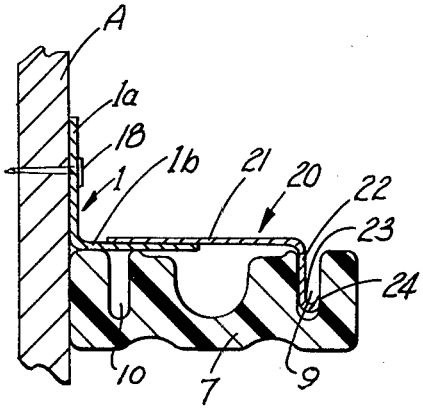
FIG. 2 is a sectional view, fragmentary in nature, illustrating the manner of support of a trim body with respect to the wall angle.

Since it is also desirable to provide for the covering of the wall angles 1, the same being illustrated in FIG. 2 as comprising a mounting flange 1a and a support flange 1*b*, which extends outwardly from the wall which may be designated A, being fastened thereto as by means of the nail 18.

In this instance, since the wall angle flange 1b is of such an extent as to terminate along its edge about the middle of the trim body 7, it is necessary to provide a slightly different form of clip, in this instance denoted 20, having the platform portion 21 with the section including the leg 22 and terminating with an upturned offstanding element 23 reversely bent in the same manner as the corresponding section of the clip 12 previously described.

The platform portion 21 is ofconsiderably longer extent than the corresponding portion 13 of the clip 12 so that the end of said portion 21 will overlie the flange 1b of the wall angle 1 and thereby in turn support the trim body 7 in position so as to cover the lower surface of the flange 1b.

It will be apparent that suitable cutting and trimming of the respective trim bodies to fit and form a general gridwork over the grid members 1, 2, 3 and 4 will be accomplished to hereby provide a decorative trim appearance to the ceiling different from the usual grid members previously supplied.

As is true of the clip 12, the edge 24 of the clip 20 will interengage with the relatively resilient side of the recess 9, and thereby maintain the trim body 7 in place as was true of the trim body 7 with regard to FIG. 3.

The respective clips disclosed will make possible some variation in both the thickness and configuration of the trim bodies and yet rather firmly position the same with regard to the grid members from which they are supported.

I claim:

1. In suspended ceiling construction of the class described, in combination, grid members for supporting ceiling panels, said members having a normally exposed surface and at least one generally horizontal flange to support ceiling panels thereon, a trim body to cover said exposed surface, said body having a recess therein including spaced sides, and trim body mounting means comprising a series of clips, each having a portion extending over the said flange and a section seated in the recess whereby to engage at least one side thereof to maintain the trim body in juxtaposition with said normally exposed surface to cover the same.

2. Trim body mounting means as claimed in claim 1, wherein the clips comprise a platform and a leg depending therefrom, said leg including an offstanding element to interengage with one side of the recess when the leg is positioned therein.

3. Mounting means as claimed in claim 1, wherein the clips are formed of spring-like material, the portion constituting a platform engaging the flange, the section comprising a depending leg at right angles to the platform to engage one side of the recess when inserted therein, and an offstanding angular element to engage the other side of the recess, whereby to maintain the trim body in position with respect to the grid member.

4. The combination as claimed in claim 3, wherein the offstanding angular element is reversely bent and having resilient connection to the leg whereby the leg and element interlock with the recess when positioned therein to resist removal therefrom.

5. The combination as claimed in claim 1, wherein the sides of the recess in the trim body are relatively resilient, and the section of the clip seated in the recess includes a surface engaging one side thereof and an element formed to interlock with the opposite side to resist disengagement of the trim body from the surface as aforesaid.

6. Ceiling construction as claimed in claim 1, wherein certain of the grid members are of inverted T-shape in cross section, the cross part constituting the flange and having the exposed surface to be covered by the trim body, the body is formed with a pair of parallel grooves, each comprising a recess, each recess having spaced sides, and the series of clips are positioned at opposite sides of the cross part with a portion of each extending thereover, each clip likewise having a section seated in its respective recess to engage the sides thereof and maintain the trim body in alignment and juxtaposition as stated.

* * * * *